US007118412B2

(12) United States Patent
Lim

(10) Patent No.: US 7,118,412 B2
(45) Date of Patent: Oct. 10, 2006

(54) APPARATUS FOR FIXING CONNECTOR FOR AIRBAG MODULE

(75) Inventor: Gyu Sung Lim, Seoul (KR)

(73) Assignee: Hyundai Mobis Co., Ltd., Yongin-shi (KR)

( * ) Notice: Subject to any disclaimer, the term of this patent is extended or adjusted under 35 U.S.C. 154(b) by 295 days.

(21) Appl. No.: 10/651,224

(22) Filed: Aug. 29, 2003

(65) Prior Publication Data

US 2005/0035575 A1 Feb. 17, 2005

(30) Foreign Application Priority Data

Aug. 13, 2003 (KR) ..... 10-2003-0056239

(51) Int. Cl.
*H01R 13/60* (2006.01)

(52) U.S. Cl. ..... 439/532

(58) Field of Classification Search ..... 439/532, 439/542, 569, 571, 576
See application file for complete search history.

(56) References Cited

U.S. PATENT DOCUMENTS 5,356,309 A * 10/1994 Carney et al. ..... 439/532
5,624,276 A * 4/1997 Otto et al. ..... 439/532
5,989,062 A * 11/1999 Daoud ..... 439/532

* cited by examiner

*Primary Examiner*—Gary F. Paumen
(74) *Attorney, Agent, or Firm*—Greenblum & Bernstein, P.L.C.

(57) ABSTRACT

Disclosed herein is an apparatus for fixing a connector for an airbag module. The apparatus comprises a clip integrally formed with a connector, and a connector bracket attached to an airbag case. The connector bracket is inserted in an insertion opening of the clip. The connector bracket has an engagement hole formed at one side thereof so that a hook of the clip is engaged in the engagement hole. The connector is directly fixed to the airbag module by simply inserting the connector into the connector bracket.

6 Claims, 7 Drawing Sheets

APPARATUS FOR FIXING CONNECTOR FOR AIRBAG MODULE

BACKGROUND OF THE INVENTION

1. Field of the Invention

The present invention relates to an apparatus for fixing a connector for an airbag module, and more particularly to an apparatus for fixing a connector for an airbag module that is capable of directly fixing the connector to a connector bracket.

2. Description of the Related Art

As shown in FIG. 1, an airbag module generally comprises: an airbag housing 4 mounted to an instrument panel for accommodating an airbag 2; a can housing 8 attached to the airbag housing 4, the can housing 8 having a mounting bracket 6, which is fixed to a cowl cross member by means of bolts, provided at the outside thereof; an inflator 10 inserted in the can housing 8 for supplying a high-pressure gas to the airbag 2 when an electric current is applied so that the airbag 2 is expanded; and an impact sensor for sensing a collision of a car so that the electric current is applied to the inflator.

To the can housing 8 is fixed a connector 10 for supplying the electric current to the inflator 9.

As shown in FIGS. 1 to 3, a conventional apparatus for fixing a connector comprises: a connector bracket 20 formed integrally with the mounting bracket 6 and having an insertion hole 21 formed at one side thereof; a connector holder 30 inserted in the insertion hole 21 of the connector bracket 20; and a clip 40 formed at the connector 10 for coupling the connector 10 with the connector holder 30.

The connector bracket 20 comprises: a supporting part 22 connected to the mounting bracket 6 for supporting the connector 10; and a coupling part 23 upwardly and vertically extended from the supporting part 22. The insertion hole 21 is formed in the coupling part 23 of the connector bracket 20.

The connector holder 30 comprises: a partition wall 34 having an insertion protrusion formed at the one side thereof, which is inserted in the insertion hole 21 of the connector bracket 20; a first hook 35 flexibly formed at the insertion protrusion 32 in such a manner that the first hook 35 is engaged in the insertion hole 21 of the connector bracket 20; upper and lower linking members 37 and 38 each formed at the other side of the partition wall 34 in such a manner that the upper and lower linking members 37 and 38 are engaged in the clip 40, the upper and lower linking members 37 and 38 having second hooks 36 formed at the right ends thereof, respectively, in such a manner that the second hooks 36 of the upper and lower linking members 37 and 38 are protruded toward the partition wall 34; and a bridge 39 for connecting the upper and lower linking members 37 and 38.

The clip 40 comprises: a main body 42 having an insertion opening 41 formed therethrough in such a manner that the insertion opening is opened in the right and left directions, the upper and lower linking members 37 and 38 being engaged in the main body 42 through the insertion opening 41; and a hook 44 formed at the main body 42 in such a manner that the hook 44 is protruded toward the insertion opening 41 of main body 42, the hook 44 being engaged with the bridge 39 of the connector holder 30. The main body 42 of the clip 40 is provided at the right end thereof with a cutout part 46, with which the second hooks 36 of the connector holder 30 are engaged.

The assembly operation of the conventional connector with the above-stated construction will now be described.

The assembly of the connector 10 and the connector holder 30 is as follows: the upper and lower linking members 37 and 38 of the connector holder 30 are inserted into the insertion opening 41 of the clip 40 so that the clip 40 is engaged with the connector holder 30.

At the time when the clip 40 is completely engaged with the connector holder 30, the hook 44 of the clip 40 is engaged with the bridge 39 of the connector holder 30. At the same time, the second hooks 36 of the connector holder 30 are engaged with the cutout part 46 of the clip 40 so that the clip and the connector holder 30 are not disengaged from each other. In this way, the connector 10 is coupled with the connector holder 30 by means of the clip 40.

The assembly of the connector holder 30 and the connector bracket 20 is as follows: when the insertion protrusion 32 of the connector holder 30 is inserted into the insertion hole 21 of the connector bracket 20, the first hook 35 of the connector holder 30 is engaged with the connector bracket 20. In this way, the connector holder 30 is coupled with the connector bracket 20.

As described above, the connecter bracket 20 and the connector holder 30 are coupled with each other, and the connector holder 30 and the clip 40 are coupled with each other. Consequently, the connector 10 is securely fixed to the airbag module.

In the conventional apparatus for fixing the connector, however, the connector 10 is fixed to the airbag module by means of the clip 40, the connector holder 30, and the connector bracket 20. As a result, numerous parts for fixing the connector are required. Furthermore, the assembly operation is complicated, and thus the cost of assembly the connector is very high.

In addition, the hook 46 of the clip 40, the first and second hooks 35 and 36 of the connector holder 30 must be flexible. Consequently, it is required that the connector 10, the clip 40, and the connector holder 30 be made of plastic materials. In this case, however, the respective coupled parts may be easily broken, and the respective coupled parts may be loosened or plastically deformed. Consequently, the connector 10 is not securely and reliably assembled, and thus the connector 10 is affected by vibration.

SUMMARY OF THE INVENTION

Therefore, the present invention has been made in view of the above problems, and it is an object of the present invention to provide an apparatus for fixing a connector for an airbag module that is capable of securely fixing the connector to a connector bracket wherein the assembly operation of the connector is simplified.

In accordance with the present invention, the above and other objects can be accomplished by the provision of an apparatus for fixing a connector for an airbag module, comprising: a connector for supplying an electric current to an airbag module including an airbag case; a clip integrally formed with the connector in such a manner that the clip is protruded from the connector, the clip having an insertion opening formed therethrough and a hook protruded toward the insertion opening; and a connector bracket attached to the airbag case, the connector bracket being inserted in the insertion opening of the clip and having an engagement hole formed at one side thereof so that the hook of the clip is engaged in the engagement hole.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
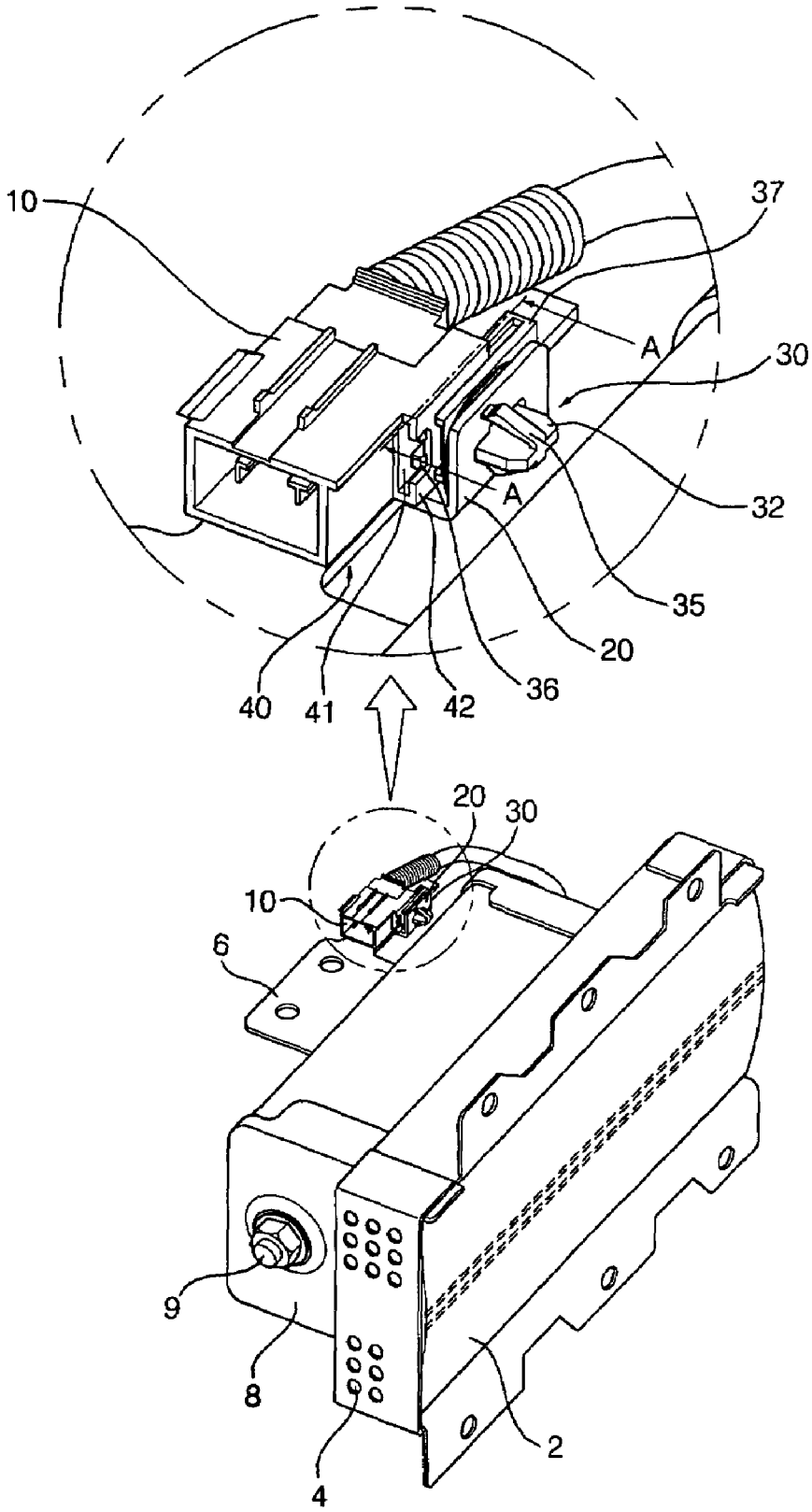
Fig. 1(Prior Art)
FIG. 1 is a perspective view showing a conventional apparatus for fixing a connector for an airbag module.
Figure 2:
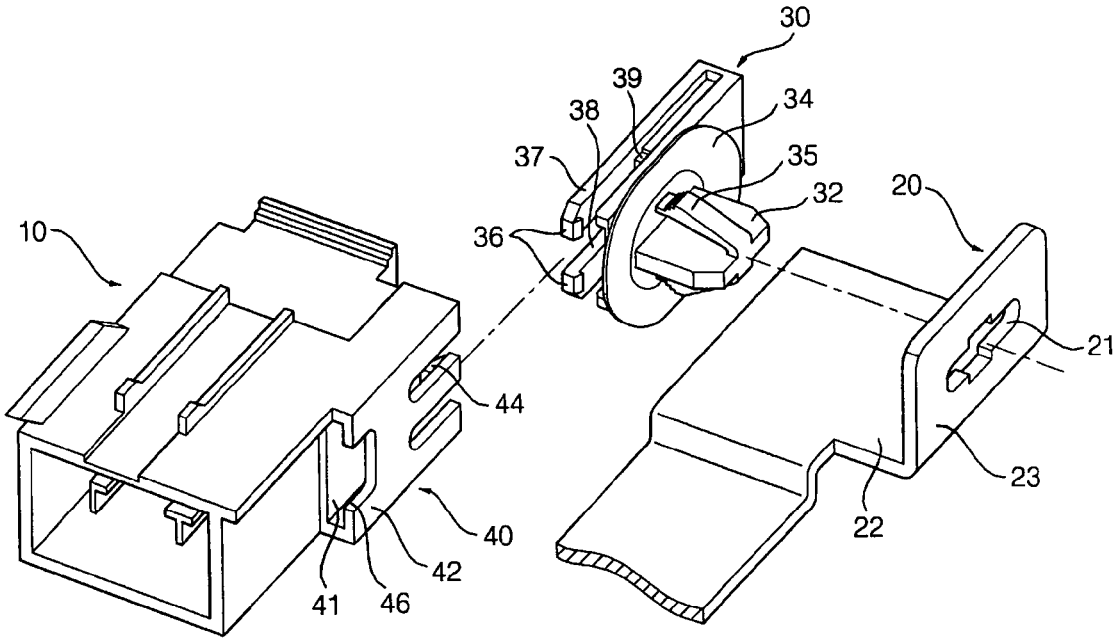
Fig. 2(Prior Art)
FIG. 2 is an exploded perspective view showing a conventional apparatus for fixing the connector for the airbag module.
Figure 3:
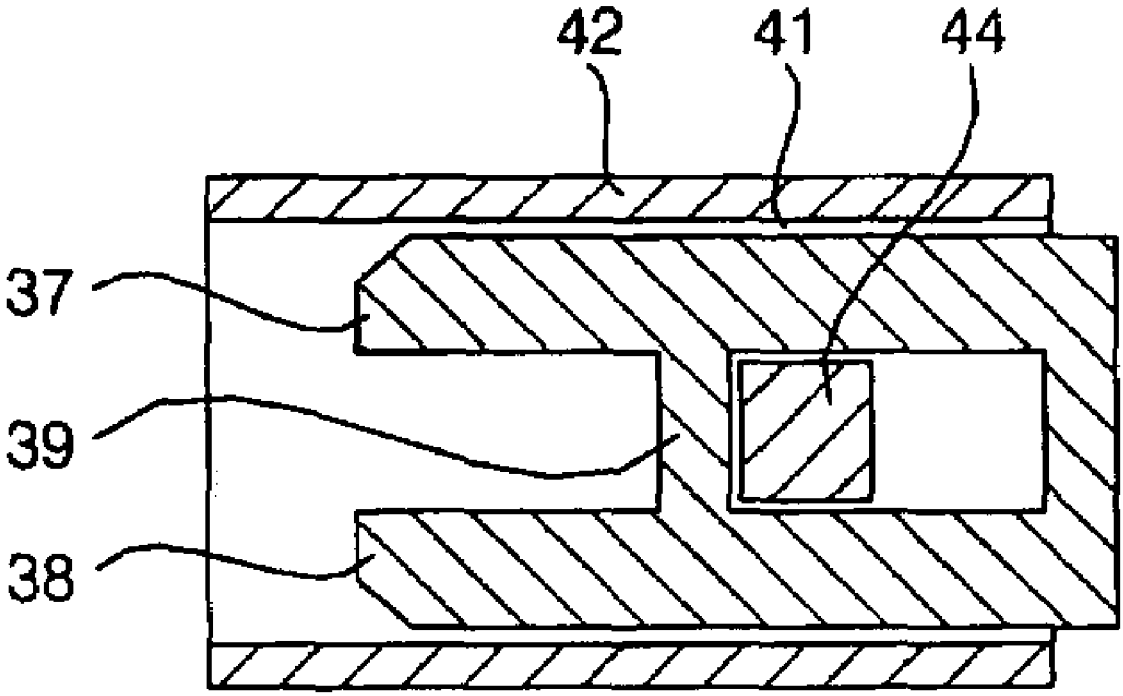
FIG. 3 is a cross-sectional view taken along line A–A' of FIG. 1.
Figure 4:
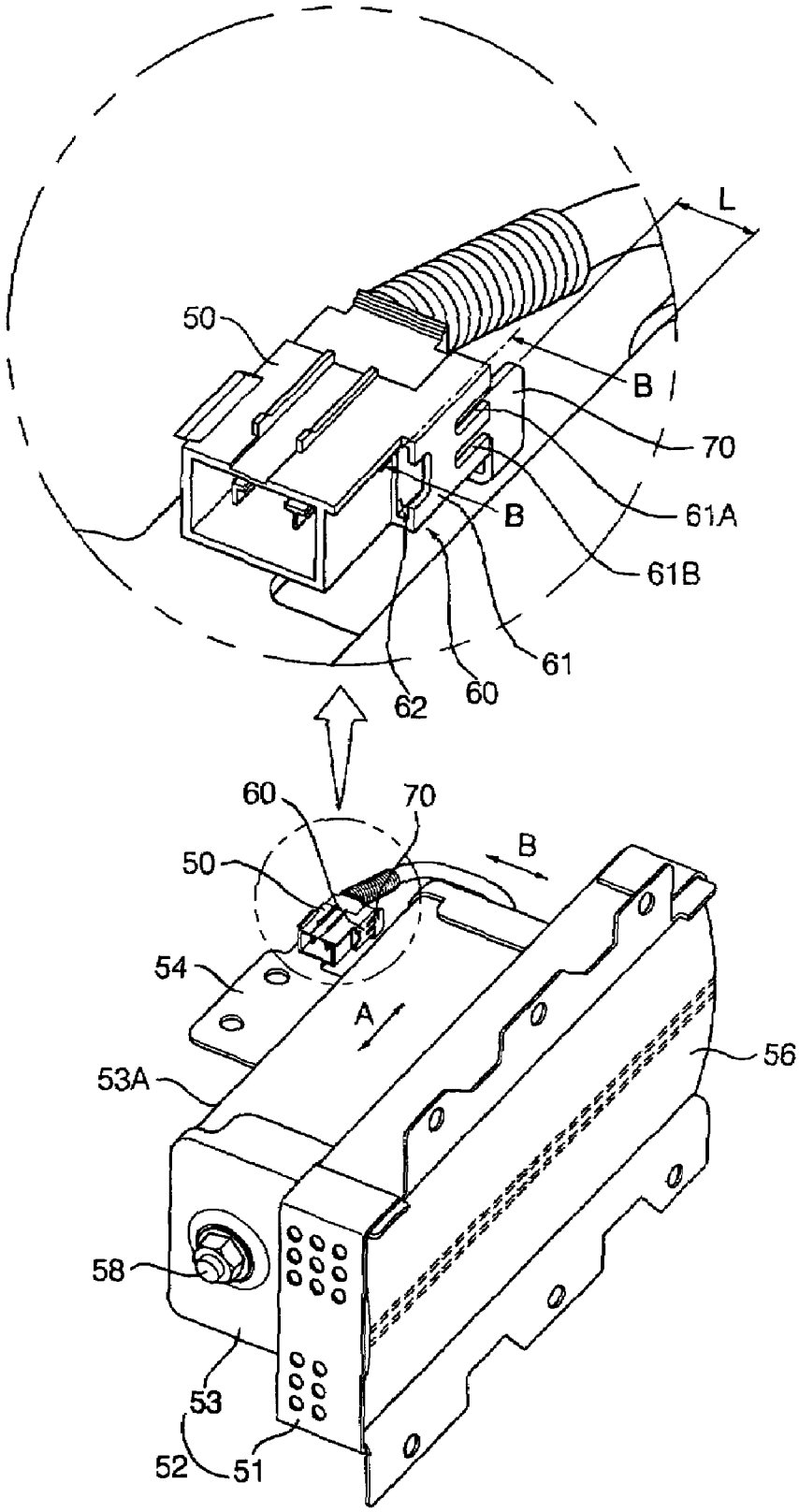
FIG. 4 is a perspective view showing an apparatus for fixing a connector for an airbag module according to a first preferred embodiment of the present invention.
Figure 5:
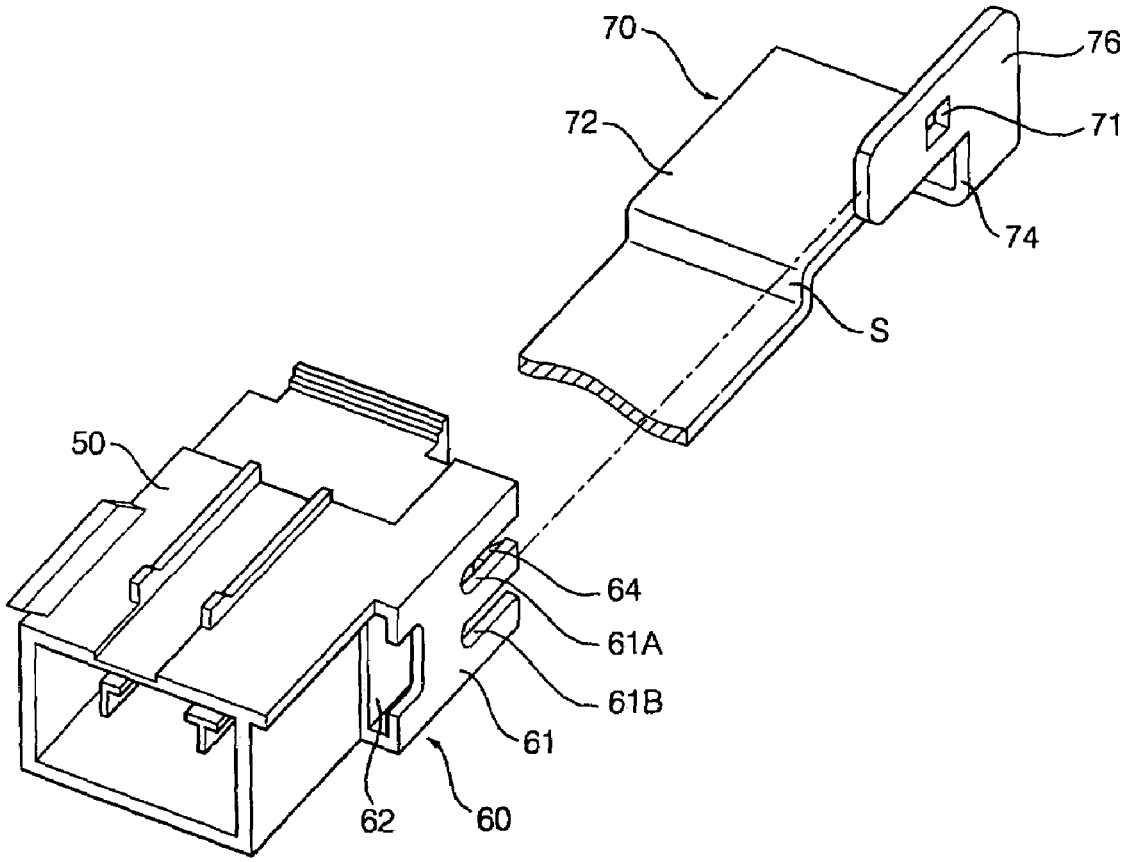
FIG. 5 is an exploded perspective view showing the apparatus for fixing the connector for the airbag module according to the first preferred embodiment of the present invention.
Figure 6:
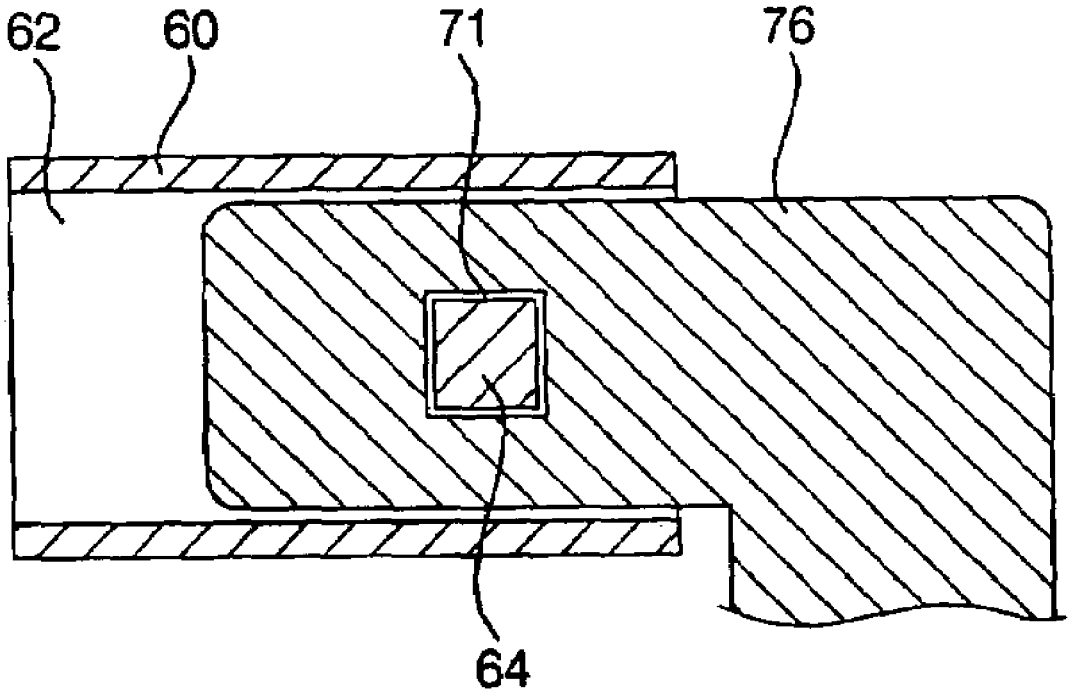
FIG. 6 is a cross-sectional view taken along line B–B' of FIG. 4.

FIG. 4 is a perspective view showing an apparatus for fixing a connector for an airbag module according to a first preferred embodiment of the present invention, FIG. 5 is an exploded perspective view showing an apparatus for fixing a connector for an airbag module according to a first preferred embodiment of the present invention, and FIG. 6 is a cross-sectional view taken along line B–B' of FIG. 4.

The apparatus for fixing the connector for the airbag module according to the first preferred embodiment of the present invention comprises: a connector 50 for supplying an electric current to an airbag module; a clip 60 integrally formed with the connector in such a manner that the clip 60 is protruded from the connector 50, the clip 60 having an insertion opening 62 formed therethrough and a hook 64 protruded toward the insertion opening 62; and a connector bracket 70 attached to an airbag case 52, the connector bracket 70 being inserted in the insertion opening 62 of the clip 60 in the longitudinal direction of the airbag case 52 (in the direction indicated by an arrow A) and having an engagement hole 71 formed at one side thereof so that the hook 64 of the clip 60 is engaged in the engagement hole 71 in the lateral direction of the airbag case 52 (in the direction indicated by an arrow B).

The clip 60 is integrally formed with the connector 50 at one side of the connector 50. The insertion opening 62 is formed through the clip 60 in the longitudinal direction of the airbag case 52 (in the direction indicated by the arrow A). The clip 60 has an outer wall 61 separated from the connector 50. At outer wall 61 of the clip 60 are formed upper and lower cutout parts 61A and 61B, which are cut in the longitudinal direction of the airbag case 52 at the upper and lower parts of the outer wall 61 about the hook 64 so that the hook 64 is flexible in the lateral direction of the airbag case 52 (in the direction indicated by the arrow B).

The connector bracket 70 is mounted to the rear surface 53A of the airbag case 52 in the lateral direction of the airbag case 52 (in the direction indicated by the arrow B). The connector bracket 70 is integrally formed with a mounting bracket 54, which is mounted to the rear surface 53A of the airbag case 52 in the lateral direction of the airbag case 52 (in the direction indicated by the arrow B) for fixing the airbag case 52 to the body of a car.

The airbag case 52 comprises: an airbag housing 4 mounted to an instrument panel for accommodating an airbag 56; and a can housing 53 attached to the rear part of the airbag housing 51 in the lateral direction of the airbag case 52 (in the direction indicated by the arrow B). In the can housing 53 is accommodated an inflator 58 supplying gas so that the airbag is expanded when a collision occurs. The connector bracket 70 is mounted to the rear surface 53A of the can housing 53.

The connector bracket 70 comprises: a supporting part 72 connected to the mounting bracket 54 in the longitudinal direction of the airbag case 52 (in the direction indicated by the arrow A) for supporting the connector 50; a holding part 74 upwardly and vertically extended from the supporting part 72, the holding part 74 being formed in the shape of a square; and an inserting part 76 vertically formed at the upper end of the holding part 74 in such a manner that the inserting part 76 is extended toward the insertion opening 62 of the clip 60 in the longitudinal direction of the airbag case 52 (in the direction indicated by the arrow A). The inserting part 76 of the bracket 70 is inserted into the insertion opening 62 of the clip 60.

The supporting part 72 of the connector bracket 70 is disposed at a position higher than that of the mounting bracket 54 so that the supporting part 72 of the connector bracket 70 is connected to the mounting bracket 54 in the shape of steps with a height of S.

The holding part 74 of the connector bracket 70 is spaced a predetermined distance L from the rear surface 53A of the can housing 53 in the lateral direction of the airbag case 52 (in the direction indicated by the arrow B) so that interference between the clip 60 and the airbag case 52 is prevented when the clip 60 is coupled with the connector bracket 70.

The sectional area of the inserting part 76 of the connector bracket 70 is slightly smaller than that of the insertion opening 62 of the clip 60, and the length of the inserting part 76 of the connector bracket 70 is larger than that of the insertion opening 62 of the clip 60 in the longitudinal direction of the airbag case 52 (in the direction indicated by the arrow A), so that the inserting part 76 of the connector bracket 70 is easily inserted into the insertion opening 62 of the clip 60. When the inserting part 76 of the connector bracket 70 is completely inserted into the insertion opening 62 of the clip 60, the hook 64 of the clip 60 is engaged in the engagement hole 71 of the inserting part 76 in the lateral direction of the airbag case 52 (in the direction indicated by an arrow B).

The operation of the apparatus for fixing the connector with the above-stated construction according to the first preferred embodiment of the present invention will now be described.

First, the connector bracket 70 and the mounting bracket 54 are mounted to the airbag case 52. The connector 50 is put on the supporting part 72 of the connector bracket 70, and then the connector 50 is moved to the connector bracket 70 in the longitudinal direction of the airbag case 52 (in the direction indicated by the arrow A) so that the inserting part 76 of the connector bracket 70 is inserted into the insertion opening 62 of the clip 60.

As the inserting part 76 of the connector bracket 70 is inserted into the insertion opening 62 of the clip 60, the hook 64 of the clip 60 is flexibly bent outwardly from the clip 60 by means of the inserting part 76 of the connector bracket 70.

After the inserting part 76 of the connector bracket 70 is completely inserted into the insertion opening 62 of the clip 60, i.e., when the hook 64 of the clip 60 corresponds to the engagement hole 71 of the connector bracket 70 in the lateral direction of the airbag case 52 (in the direction indicated by the arrow B), the hook 64 of the clip 60 is engaged in the engagement hole 71 of the connector bracket 70 by virtue of the elastic restoring force of the hook 64 of the clip 60.

Consequently, the connector 50 is securely coupled with the connector bracket 70 by means of the engagement of the hook 64 of the clip 60 and the engagement hole 71 of the connector bracket 70, which is achieved simply by putting the connector 50 on the supporting part 72 of the connector bracket 70 and moving the connector 50 to the connector bracket 70.

Figure 7:
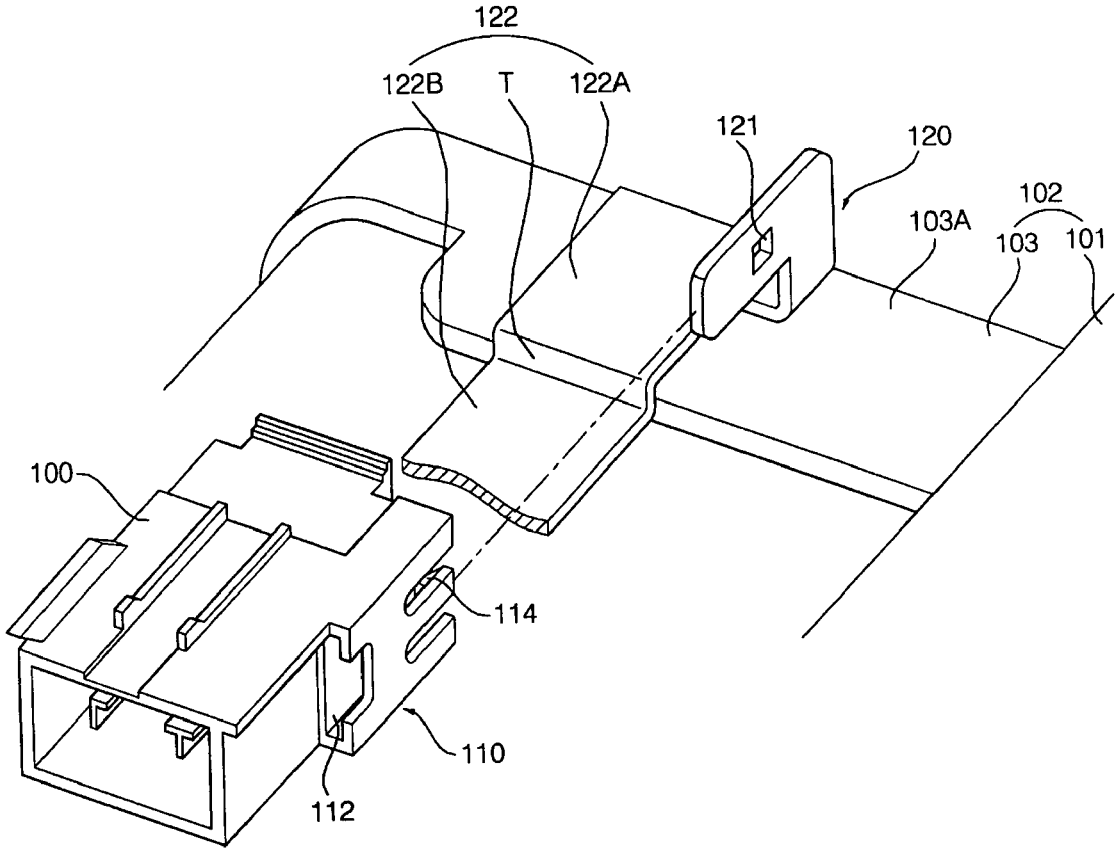
FIG. 7 is an exploded perspective view showing an apparatus for fixing a connector for an airbag module according to a second preferred embodiment of the present invention.

FIG. 7 is an exploded perspective view showing an apparatus for fixing a connector for an airbag module according to a second preferred embodiment of the present invention. The apparatus according to the second preferred embodiment of the present invention is very similar to that according to the first preferred embodiment of the present invention, and thus only the detailed description of the difference between the second preferred embodiment of the present invention and the first preferred embodiment of the present invention will be given.

The apparatus for fixing the connector for the airbag module according to the second preferred embodiment of the present invention comprises: a connector 100; a clip 60 formed at one side of the connector 100; and a connector bracket 120 attached to an airbag case 102. The connector bracket 120 is inserted in an insertion opening 112 of the clip 60. The connector bracket 120 has an engagement hole 121 formed at one side thereof so that a hook 114 of the clip 60 is engaged in the engagement hole 121. The connector bracket 120 is attached to a side surface 103A of the airbag case 102.

The airbag case 102 comprises an airbag housing 101 for accommodating an airbag, and a can housing 103 for accommodating an inflator.

Specifically, the connector bracket 120 is attached to the side surface 103A of the can housing 103. The connector bracket 120 has a supporting part 122. The supporting part 122 of the connector bracket 120 is formed in such a manner that a connector supporting region 122A of the supporting part 122 is disposed at a position higher than that of a region 122B attached to the side surface 103A of the can housing 103 so that the connector supporting region 122A of the supporting part 122 is connected to the region 122B attached to the side surface 103A of the can housing 103 in the shape of steps with a height of T in the direction in which the connector supporting region 122A of the supporting part 122 is away from the side surface 103A of the can housing 103, whereby interference between the connector 100 and the can housing 103 is prevented.

As apparent from the above description, the present invention provides an apparatus for fixing a connector for an airbag module, comprising a clip integrally formed with a connector, and a connector bracket attached to an airbag case, wherein the connector bracket is inserted in an insertion opening of the clip, and the connector bracket has an engagement hole formed at one side thereof so that a hook of the clip is engaged in the engagement hole, whereby it is possible to easily fix the connector to the airbag module by simply inserting the connector into the connector bracket. Also, the number of the parts and the number of steps of the assembly operation are reduced, and thus the cost of assembly is reduced.

Furthermore, the connector is directly coupled with the connector bracket without additional parts, whereby damage or loosening of respective coupled parts between the connector and the connector bracket is prevented, and a negative effect on the connector by vibration is reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for fixing a connector for an airbag module, comprising:

a connector that supplies an electric current to an airbag module including an airbag case;

a clip integrally formed with the connector in such a manner that the clip is protruded from the connector, the clip having an insertion opening formed therethrough and a hook protruding into the insertion opening; and a connector bracket attached to the airbag case, the connector bracket being inserted in the insertion opening of the clip and having an engagement hole provided at one side thereof so that the hook of the clip is engaged in the engagement hole, wherein the connector bracket includes an inserting part vertically formed at an upper end of a holding part and extending toward the insertion opening of the clip in a longitudinal direction of the airbag case.

2. The apparatus as set forth in claim 1, wherein the connector bracket further comprises a supporting part attached to the airbag case to support the connector; the holding part vertically extending from the supporting part; the inserting part being inserted into the insertion opening of the clip, and the inserting part having the engagement hole provided therein.

3. The apparatus as set forth in claim 2, wherein the airbag case comprises: an airbag housing that accommodates the airbag; and a can housing that accommodates an inflator, which supplies gas so that the airbag is expanded when a collision occurs, and wherein the connector bracket is mounted to the rear surface of the can housing.

4. The apparatus as set forth in claim 3, wherein the connector bracket has a mounting bracket formed integrally therewith, the mounting bracket being mounted to the rear surface of the can housing and fixed to the body of a car.

5. The apparatus as set forth in claim 2, wherein the airbag case comprises: an airbag housing that accommodates the airbag; and a can housing that accommodates an inflator, which supplies gas so that the airbag is expanded when a collision occurs, and wherein the connector bracket is mounted to a side surface of the can housing opposite to the airbag housing.

6. The apparatus as set forth in claim 5, wherein the supporting part of the connector bracket is provided in such a manner that a connector supporting region of the supporting part is disposed at a position higher than that of a region attached to the side surface of the can housing so that the connector supporting region of the supporting part is connected to the region attached to the side surface of the can housing in the shape of a step with a predetermined height in the direction in which the connector supporting region of the supporting part is away from the can housing.

* * * * *